US008370997B2

(12) United States Patent
Wright

(10) Patent No.: US 8,370,997 B2
(45) Date of Patent: Feb. 12, 2013

(54) RATCHET STRAP

(75) Inventor: Douglas Wright, Piedmont, SC (US)

(73) Assignee: Ratchet Depot, Inc., Piedmont, SC (US)

( * ) Notice: Subject to any disclaimer, the term of this patent is extended or adjusted under 35 U.S.C. 154(b) by 437 days.

(21) Appl. No.: 12/686,820

(22) Filed: Jan. 13, 2010

(65) Prior Publication Data

US 2011/0167599 A1 Jul. 14, 2011

(51) Int. Cl.
*B60P 7/06* (2006.01)
*B65D 63/00* (2006.01)
*B25B 25/00* (2006.01)

(52) U.S. Cl. ..... 24/68 CD; 24/68 R; 24/265 CD; 24/909; 254/217; 254/218; 254/238; 410/100

(58) Field of Classification Search ..... 24/68 R, 24/68 CD, 69 CT, 69 ST, 70 ST, 265 CD, 24/909; 254/217, 218, 238, 239; 410/100
See application file for complete search history.

(56) References Cited

U.S. PATENT DOCUMENTS

| | | | | |
|---|---|---|---|---|
| 5,271,606 | A | 12/1993 | Kamper | 254/217 |
| 5,426,826 | A | 6/1995 | Takimoto | 24/68 |
| 5,611,520 | A * | 3/1997 | Soderstrom | 254/218 |
| 5,908,274 | A | 6/1999 | Silberman | 410/10 |
| 5,941,666 | A * | 8/1999 | Waters | 410/100 |
| 5,961,263 | A * | 10/1999 | Nunez | 410/103 |
| 6,524,041 | B1 | 2/2003 | Voiculescu | 410/100 |
| 6,796,758 | B2 * | 9/2004 | Coslovi et al. | 410/100 |
| 7,017,847 | B2 * | 3/2006 | Treat | 242/395 |
| 7,100,902 | B1 * | 9/2006 | Lu | 254/218 |
| 7,296,326 | B2 * | 11/2007 | Madachy et al. | 24/68 CD |
| 7,377,484 | B1 * | 5/2008 | Williams | 254/218 |
| 7,861,382 | B1 | 1/2011 | Madachy et al. | |
| 7,874,047 | B2 * | 1/2011 | Breeden | 24/68 CD |
| 8,037,580 | B2 * | 10/2011 | Huang | 24/68 CD |
| 8,172,203 | B2 * | 5/2012 | Chou | 254/225 |
| 2003/0145434 | A1 * | 8/2003 | Lin | 24/68 CD |
| 2004/0094650 | A1 * | 5/2004 | Huang | 242/385.4 |
| 2007/0056146 | A1 * | 3/2007 | Madachy et al. | 24/68 CD |
| 2007/0122247 | A1 * | 5/2007 | Madachy et al. | 410/100 |
| 2007/0221897 | A1 * | 9/2007 | Cardona | 254/218 |
| 2007/0267611 | A1 * | 11/2007 | Leone et al. | 254/218 |
| 2008/0189921 | A1 * | 8/2008 | Tomosue | 24/68 R |
| 2010/0180412 | A1 * | 7/2010 | Huang | 24/71 ST |
| 2010/0247265 | A1 * | 9/2010 | Jensen | 410/100 |
| 2011/0146035 | A1 * | 6/2011 | Lu | 24/68 CD |
| 2012/0110801 | A1 * | 5/2012 | Joubert et al. | 24/68 CD |

* cited by examiner

*Primary Examiner* — Robert J Sandy
*Assistant Examiner* — Tyler Johnson
(74) *Attorney, Agent, or Firm* — Joseph T. Guy; Nexsen Pruet, LLC

(57) ABSTRACT

Described is a ratchet strap with a free end securing system. The ratchet strap has a strap with an attachment end and a free end and a strap winding shaft which is capable of receiving the free end in a wrapped relationship. A ratchet mechanism is included for simultaneously shortening the attachment end and the free end wherein the free end is drawn from the wrapped relationship with the strap winding shaft.

9 Claims, 4 Drawing Sheets

RATCHET STRAP

BACKGROUND OF THE INVENTION

The present invention is related to an improved ratchet strap. More particularly the present invention is related to an improved ratchet strap wherein the free end is secured.

Ratchet straps are commonly used in many areas of commerce including, without limit, hauling freight. A ratchet strap typically has an end of fixed length and an end of variable length with a ratchet mechanism capable of reducing the length of strap between two points thereby tightly securing an item to a transport trailer or the like.

A typical ratchet strap is illustrated in top view in FIG. 1, without the strap, and in cross-sectional view in FIG. 2 taken along line 2-2 of FIG. 2 with the strap in place. The ratchet strap, generally represented at 1, comprises a mandrel, 3, with a slot, 2, therein. In use a strap, 4, is slid into the slot until a suitable amount of slack has been removed between the mandrel and a hook, 5. The free end of the strap is that section extending away from the mandrel opposite the attachment side which comprises a hook. The length of the free end is longer if the strap is expanding across a small length but decreases as the strap extends across a larger length. The free end must be secured which is a constant problem in the art and a problem which is solved herein.

The ratchet mechanism is not particularly limited herein with the ratchet mechanism illustrated in FIGS. 1 and 2 being a sufficient representation to explain the invention.

With reference to FIGS. 1 and 2 the mandrel has attached thereto a ratchet wheel, 6, with cams, 7, thereon. The cams are sufficient to allow a frame pawl, 8, to be persuaded away from the ratchet wheel upon rotation in one direction (clockwise as depicted in FIG. 2) but to oppose rotation in the opposite direction. The frame pawl is persuaded towards the ratchet wheel by a frame spring, 9. A mechanism is typically provided to allow the frame pawl to be disengaged with the cams of the ratchet wheel thereby allowing release of the strap.

A ratchet handle, 11, rotates the ratchet wheel, and attached mandrel. As the mandrel rotates a portion of the attachment end, and free end, of the strap wraps around the mandrel thereby tightening the strap around the item being secured. A ratchet pawl, 12, preferably slidably attached to the ratchet handle engages with the cams of the ratchet wheel. As the handle is moved in an arcuate motion in the direction of the arrow, 13, the mandrel rotates thereby wrapping strap there around. As the mandrel rotates a sufficient amount the counter-rotation is prohibited by the frame pawl engaging with successive cams. A ratchet spring, 14, persuades the ratchet pawl into engagement with the cams. As the handle is rotated back in a direction counter to arrow 13 the ratchet pawl is persuaded away from the cam until a position is reached wherein additional rotation of the sprocket can begin. A ratchet release handle, 15, is provided for persuading the ratchet pawl out of engagement with the ratchet wheel thereby allowing the strap to be released. The ratchet release handle and frame pawl release handle may be separate, integral or operable in a single operation. In one embodiment the ratchet pawl is withdrawn and the handle rotated to a position where the ratchet pawl release handle is engaged with a rest stop, 33, which also disengages the frame pawl thereby allowing for free rotation of the mandrel.

The handle, 11, comprises a pair of side supports, 17, with a grip, 18, extending there between. The handle forms a shape substantially in the shape of the letter "U" with the open end towards the mandrel.

Though ratchet straps are in widespread use they still have a major deficiency particularly, with regards to the free end of the strap. The present invention provides a solution to this long felt problem.

SUMMARY OF THE INVENTION

It is an object of the invention to provide an improved ratchet strap.

It is another object of the invention to provide a ratchet strap wherein the free end of the strap is secured.

A particular feature of the invention is a ratchet strap wherein the free end of the strap is secured in a manner wherein it can not be unsecured accidentally.

These and other advantages, as will be realized, are provided in a ratchet strap. The ratchet strap has a strap with an attachment end and a free end and a strap winding shaft which is capable of receiving the free end in a wrapped relationship. A ratchet mechanism is included for simultaneously shortening the attachment end and the free end wherein the free end is drawn from the wrapped relationship with the strap winding shaft.

Yet another embodiment is provided in a ratchet strap assembly. The ratchet strap assembly has a strap with an attachment end and a free end. A wrapping mechanism reversibly wraps the free end around a strap winding shaft. The wrapping mechanism has a handle connector attached to the strap winding shaft and a first handle pivotally attached to the handle connector. A ratchet mechanism has a ratchet handle wherein movement of the ratchet handle in an arcuate motion simultaneously wraps the attachment end and the free end around a mandrel wherein the free end is drawn from the wrapping mechanism. The first handle is pivotal into and out of engagement with said ratchet handle.

A particularly preferred embodiment is provided in a method for securing a load. The method includes: providing a ratchet strap assembly wherein the ratchet strap assembly has a strap with an attachment end and a free end; a wrapping mechanism for reversible wrapping the free end around a strap winding shaft wherein the wrapping mechanism has a handle connector attached to the strap winding shaft and a first handle pivotally attached to the handle connector; a ratchet mechanism with a ratchet handle wherein movement of the ratchet handle in an arcuate motion simultaneously wraps the attachment end and the free end around a mandrel wherein the free end is drawn from the wrapping mechanism; and wherein the first handle is pivotal into and out of engagement with the ratchet handle; attaching a strap to the ratchet mechanism with an attachment end extending towards the load and the free end extending away from the load; attaching the free end to the wrapping mechanism; rotating the first handle to wrap the free end around the strap winding shaft; folding the first handle to a position to be out of engagement with the ratchet handle; moving the ratchet handle in an arcuate motion to wrap a portion of the attachment and the free end around the mandrel; and pivoting the first handle into an engaging relationship with the ratchet handle.

DETAILED DESCRIPTION

The present invention is directed to an improved ratchet strap with a tail mandrel for the free end of the strap. More particularly, the present invention is directed to an improved ratchet strap with interlocking handles wherein the free end of the strap can not be released prematurely.

The invention will be described with reference to the figures which are intended to describe the invention without limit thereto. In the various figures similar elements will be numbered accordingly.

Figure 1:
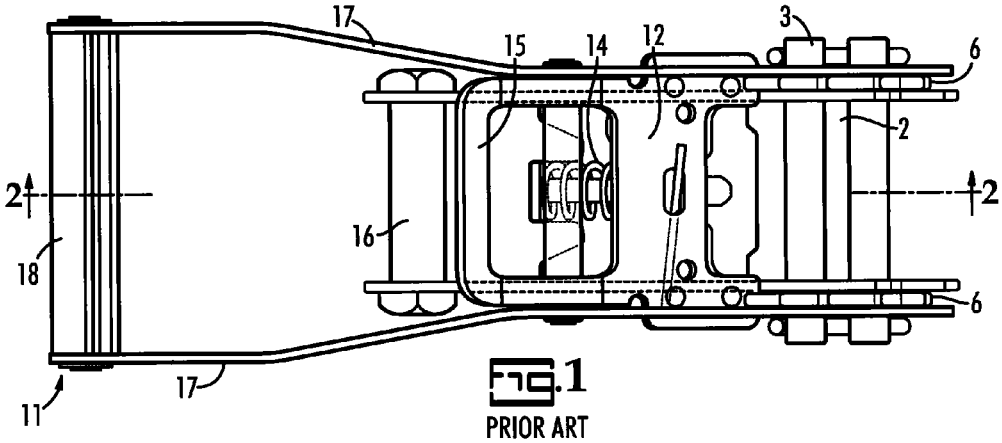
FIG.1 PRIOR ART
FIG. 1 is a top view of a prior art ratchet strap.
Figure 2:
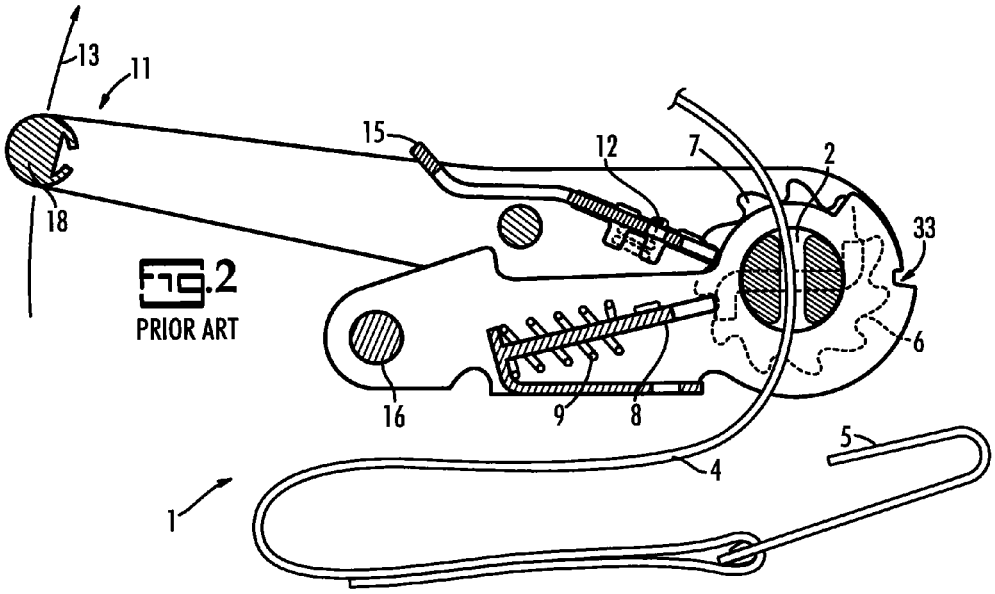
FIG.2 PRIOR ART
FIG. 2 is a cross-sectional view taken along line 2-2 of FIG. 1 with a strap further included therein.
Figure 3:
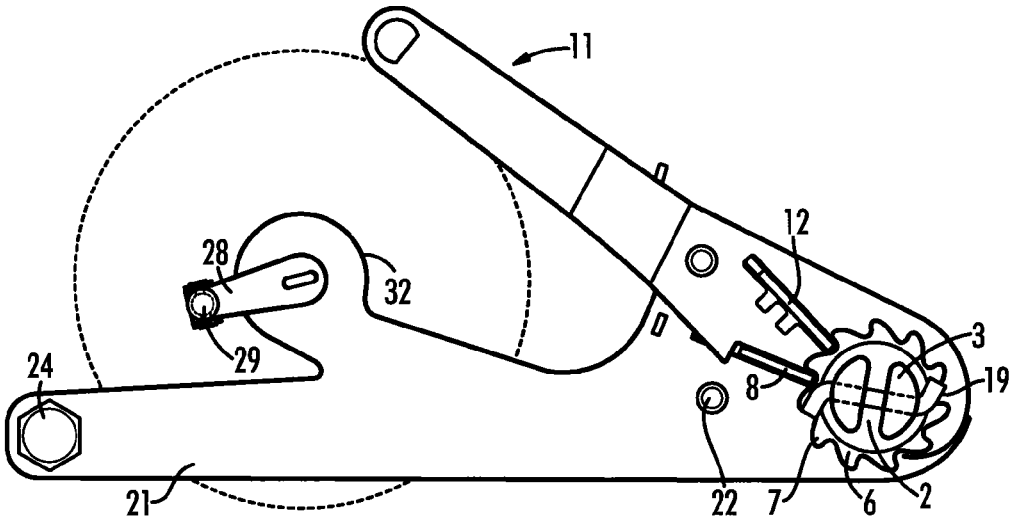
FIG. 3 is a side view of an embodiment of the invention.
Figure 4:
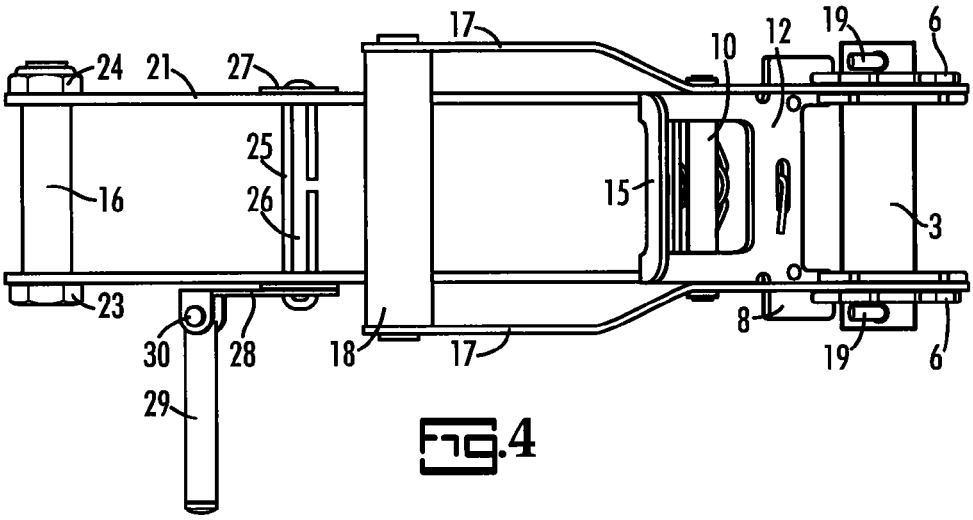
FIG. 4 is a top view of an embodiment of the invention.
Figure 5:
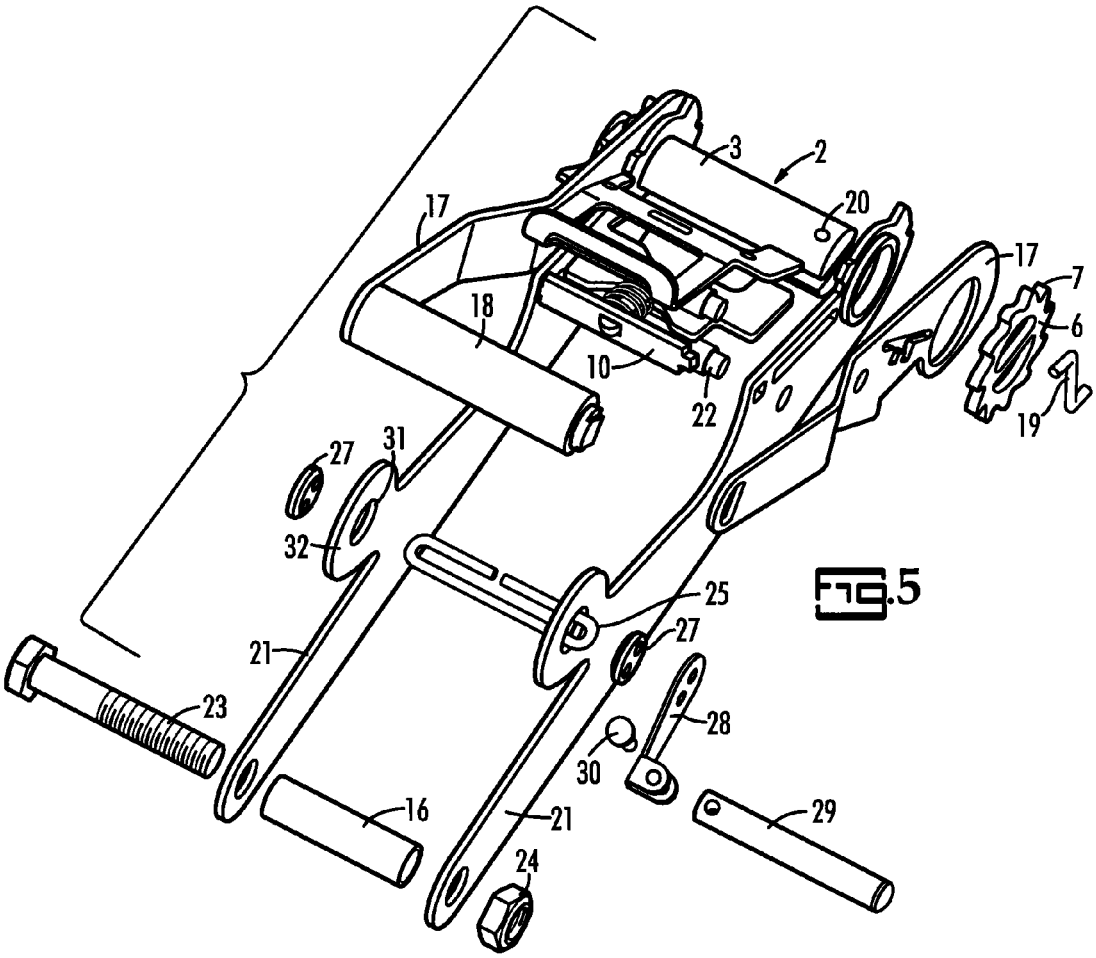
FIG. 5 is a partial exploded view of an embodiment of the invention.

The improved ratchet strap is illustrated at 100, in side view in FIG. 3, in top view in FIG. 4 and in partially exploded view in FIG. 5. The ratchet portion of the improved ratchet strap is not particularly limiting.

The ratchet mechanism comprises a mandrel, 3, with a slot, 2, for receiving a strap. The strap is not shown for clarity. The mandrel is attached to a ratchet wheel, 6, by an attachment device, 19, such as a shaft through shaft voids, 20. The attachment device is not particularly limiting with a bent shaft being most preferred due to manufacturing simplicity. Other devices, such as threaded rods with mating threaded elements, rivets, post and the like are suitable for use. A frame pawl, 8, engages with cams, 7, on the ratchet wheel to prohibit counter-rotation. A frame pawl release handle, 10, allows the frame pawl to be disengaged with the cams of the ratchet wheel. The frame pawl and frame pawl release handle may be secured to the side frame, 21, by a cross-member, 22. A bracket, 16, provides an attachment location for a rear strap which is not illustrated. The bracket, 16, may be a tube which is attached to the side frame, 21, by a threaded member, 23, which may include a mating threaded element, 24.

A strap winding shaft, 25, extends between the side frame elements, 21, and is received by, and rotates in, shaft voids, 31. The shaft voids may be in an extension, 32, of the side frame elements, 21. The strap winding shaft comprises a slot, 26, for receiving the terminal end of the strap. The strap winding shaft is held in rotational relationship with the side frame elements by keepers, 27. A handle connector, 28, connects the strap winding shaft to a handle, 29, thereby allowing the strap winding shaft to be rotated which wraps the free end of the strap around the strap winding shaft. The handle is preferably attached to the handle connector by a pivot, 30.

In use the termination of the free end of the strap is inserted into the strap winding shaft. The strap winding shaft is then rotated, by rotating the handle, to wrap the free end of the strap around the strap winding shaft. The handle is then folded against the handle connector in a parallel relationship therewith to avoid engagement with other structures such as the ratchet handle. As the ratchet handle is manipulated to rotate the strap around the mandrel the strap winding shaft is allowed to rotate freely thereby liberating strap there from to be wrapped around the mandrel.

Figure 6:
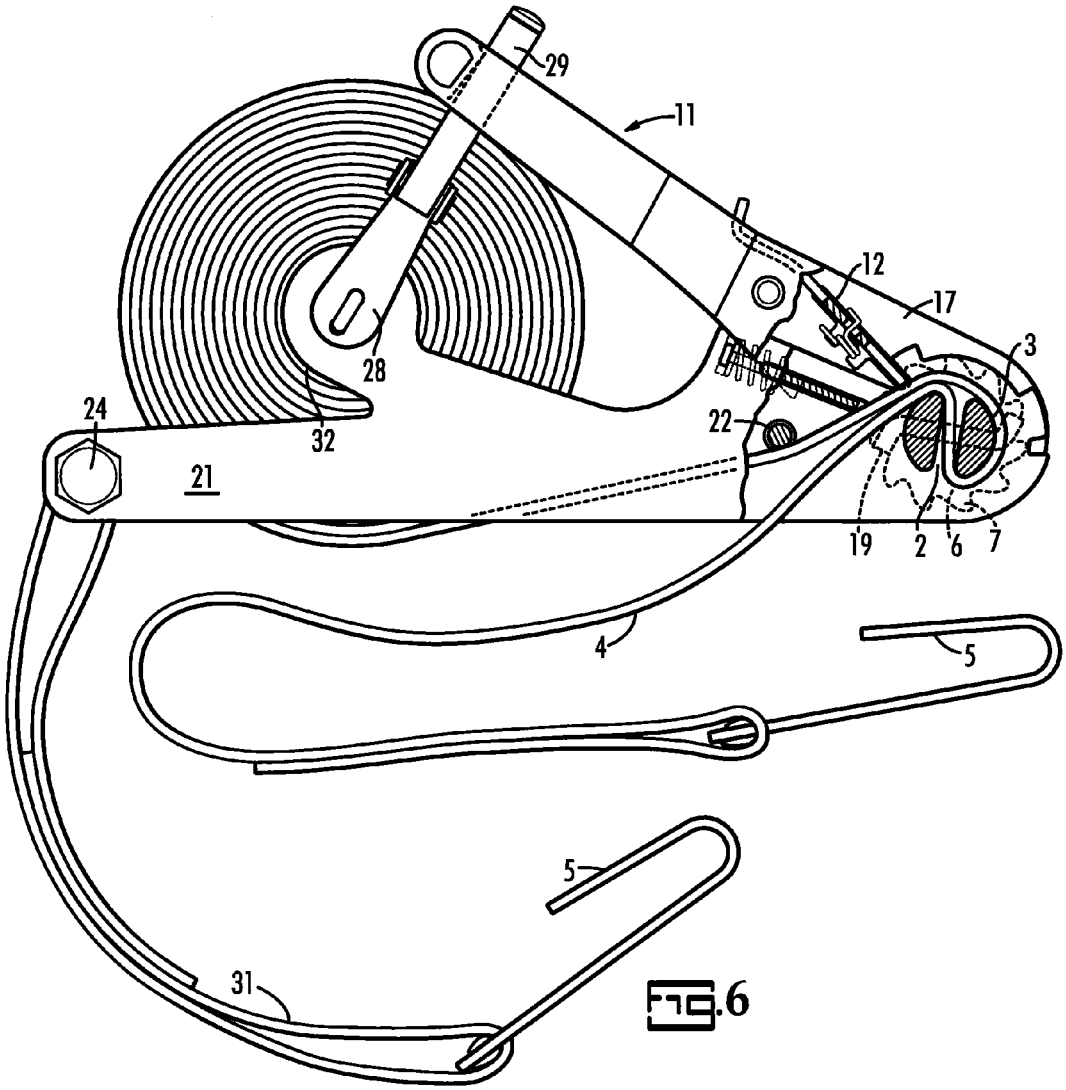
FIG. 6 is a partial cut-away view of an embodiment of the invention.

A particular embodiment is illustrated in FIG. 6. In FIG. 6, a rear strap, 31, with a hook, 5, attached thereto is attached to the bracket. The free end of the strap is wrapped around the obscured strap winding shaft to form a rolled stack, 32. The strap is wrapped around the mandrel and then extends towards a hook, 5. The handle, 29, is extended away from the connector, 28, to extend and engage with the ratchet handle. This prohibits the strap winding shaft from rotating which would allow the free end to be disengaged from the strap winding strap. The grip impedes rotation of the handle.

The invention has been described with specific reference to the preferred embodiments without limit thereto. Other embodiments and alternatives would be realized by one of skill in the art without departing from the scope of the invention which is more specifically set forth in the claims appended hereto.

Claimed is:

1. A ratchet strap comprising:

a strap comprising an attachment end and a free end;

a strap winding shaft capable of receiving said free end in a wrapped relationship; and a ratchet mechanism attached to said strap between said attachment end and said free end for simultaneously shortening said attachment end and said free end wherein said free end is drawn from said wrapped relationship with said strap winding shaft further comprising a handle connector attached to said strap winding shaft and a first handle pivotally attached to said handle connector wherein said ratchet mechanism further comprises a ratchet handle and wherein said first handle is engageable with said ratchet handle to prohibit rotation of said strap winding shaft.

2. The ratchet strap of claim 1 wherein said attachment end further comprises a hook.

3. The ratchet strap of claim 1 further comprising a rear strap.

4. A ratchet strap assembly comprising:

a strap comprising an attachment end and a free end;

a wrapping mechanism for reversible wrapping said free end around a strap winding shaft wherein said wrapping mechanism comprises a handle connector attached to said strap winding shaft and a first handle pivotally attached to said handle connector and capable of rotating from parallel to said handle connector to perpendicular to said handle connector;

a mandrel connected to said strap between said attachment end and said free end;

a ratchet mechanism comprising a ratchet handle wherein movement of said ratchet handle in an arcuate motion simultaneously wraps said attachment end and said free end around said mandrel wherein said free end is drawn from said wrapping mechanism; and wherein said first handle is pivotal into and out of engagement with said ratchet handle.

5. The ratchet strap assembly of claim 4 wherein when said first handle is engaged with said ratchet handle said free end can not be drawn from said wrapping mechanism.

6. The ratchet strap assembly of claim 4 wherein when said ratchet handle comprises side supports and a grip there between.

7. The ratchet strap assembly of claim 6 wherein said first handle is engaged with said ratchet handle between said side supports.

8. A ratchet strap assembly comprising:

a strap comprising an attachment end and a free end;

a wrapping mechanism for reversible wrapping said free end around a strap winding shaft wherein said wrapping mechanism comprises a handle connector attached to said strap winding shaft and a first handle pivotally attached to said handle connector and capable of rotating from parallel to said handle connector to perpendicular to said handle connector;

a mandrel connected to said strap between said attachment end and said free end;

a ratchet mechanism comprising a ratchet handle wherein movement of said ratchet handle in an arcuate motion simultaneously wraps said attachment end and said free end around said mandrel wherein said free end is drawn from said wrapping mechanism; and wherein said first handle is pivotal into and out of engagement with said ratchet handle wherein when said ratchet handle comprises side supports and a grip there between wherein said first handle is engaged with said ratchet handle between said side supports wherein rotation of said handle connector is impeded by engagement of said first handle with said grip.

9. A ratchet strap assembly comprising:

a pair of adjacent frame elements;

a strap comprising an attachment end and a free end extending between said frame elements;

a strap winding shaft extending between said frame elements wherein said strap winding shaft is capable of receiving said free end in a wrapped relationship; and a ratchet mechanism extending between said frame elements for simultaneously shortening said attachment end and said free end wherein said free end is drawn from said wrapped relationship with said strap winding shaft;

a ratchet handle attached to said ratchet mechanism and adapted to rotate said winding shaft;

a handle connector attached to said strap winding shaft;

a first handle pivotally attached to said handle connector wherein in a first pivoted position said first handle is perpendicular to said handle connector and in a second pivoted position said first handle engages with said ratchet handle to prohibit rotation of said strap winding shaft.

* * * * *